United States Patent [19]

Kanda et al.

[11] Patent Number: 4,506,632

[45] Date of Patent: Mar. 26, 1985

[54] PISTON ASSEMBLY WITH COOLING LUBRICANT RESERVOIR DEFINING MEMBER ENGAGED TO PISTON PIN MOUNTING BOSSES

[75] Inventors: Mutsumi Kanda; Tokuta Inoue; Souichi Matsushita; Kiyoshi Nakanishi, all of Toyota, Japan

[73] Assignee: Toyota Jidosha Kabushiki Kaisha, Toyota, Japan

[21] Appl. No.: 623,932

[22] Filed: Jun. 25, 1984

[30] Foreign Application Priority Data

Jul. 28, 1983 [JP] Japan ..... 58-138183
Jan. 24, 1984 [JP] Japan ..... 59-010677

[51] Int. Cl.[3] ..... F01P 3/10; F02F 3/20

[52] U.S. Cl. ..... 123/41.35; 92/159; 92/186; 123/193 P

[58] Field of Search ..... 123/41.35, 41.39, 193 P; 92/158, 159, 186, 208, 216

[56] References Cited

U.S. PATENT DOCUMENTS 1,321,525 11/1919 Hell Weg ..... 92/186
2,051,547 8/1936 Crist ..... 92/216
2,416,429 2/1947 Boucher ..... 92/158
3,805,677 4/1974 Clary et al. ..... 92/216

FOREIGN PATENT DOCUMENTS 58-70038 4/1983 Japan ..... 123/193 P

*Primary Examiner*—William A. Cuchlinski, Jr.
*Attorney, Agent, or Firm*—Kenyon & Kenyon

[57] ABSTRACT

A piston assembly for an internal combustion engine is made up from a piston main body and a lubricant reservoir defining member. The piston main body has a cup-shaped structure including a crown portion and a hollow cylindrical wall portion joining thereto, two piston pin bosses being formed at opposite sides of the wall portion. The lubricant reservoir defining member is made from a shelf plate main body portion which provides a central lubricant reservoir and two openings on its opposite sides, and two major legs extending from the shelf plate main body portion and each formed with a hole surrounded by an annular portion. Each of the annular portions is engaged with an inner end portion of a corresponding one of the bosses and surrounds the piston pin hole thereof. Thus the lubricant reservoir defining member is securely mounted within the cup shaped piston main body by a reliable and simple construction, with the shelf plate portion generally parallel to and opposing the piston crown and thereby providing a central lubricant reservoir for aiding with the flow of cooling lubricant flowing in and out through the two openings to flow along the underneath of the piston crown.

14 Claims, 11 Drawing Figures

PISTON ASSEMBLY WITH COOLING LUBRICANT RESERVOIR DEFINING MEMBER ENGAGED TO PISTON PIN MOUNTING BOSSES

BACKGROUND OF THE INVENTION

The present invention relates to a piston assembly for an internal combustion engine, and, more particularly, relates to a piston assembly for an internal combustion engine which incorporates an oil cooling system for cooling the piston during operation of the engine.

A piston assembly for an internal combustion engine generally becomes very hot during use, and is subjected to relatively severe thermal stresses as compared to other engine parts, especially on its top wall or crown portion which is directly exposed to the heat of the gases in the combustion chamber partly defined by the piston. This problem of heating of the crown of the piston assembly has become more and more severe with modern internal combustion engines, due to increases in thermal load on the parts thereof arising from increases in engine power output. Various schemes have been developed in the past for aiding with the cooling of such a piston assembly; and nowadays some form of active cooling for the piston assembly is coming to be quite necessary.

In particular, the concept of cooling the piston crown from below by injecting a flow of engine lubricant from the crank chamber side up into the space defined by the cup shaped piston structure including the piston crown and the piston skirt, so as to impinge against the lower side of the piston crown and to cool it, has been put forward in the past in various forms: for example, such piston cooling constructions have been proposed in Japanese Utility Model Application No. 38-11185 (Publication No. 40-19201), Japanese Utility Model Application No. 42-101852 (Publication No. 45-32981), Japanese Utility Model Application No. 49-96796 (Publication No. 54-26424), Japanese Utility Model Application No. 55-42967 (Laying Open Publication No. 57-156052), Japanese Patent Application No. 58-138183, Japanese Utility Model Application No. 58-164040, and Japanese Utility Model Application No. 58-188456. And, in particular, it has been recognized that it is helpful for such lubricant cooling of the piston crown to provide a member near the lower surface of said piston crown which defines a reservoir for temporarily and intermittently accumulating a pool of lubricant therein, so that lubricant from this pool can be splashed against the piston crown as the piston reciprocates in the cylinder bore.

Such a lubricant reservoir may be defined by a part of the piston assembly which is integrally formed or cast with the piston main body itself, or is welded thereto; but this presents difficulties such as increasing difficulty and cost of manufacture and introducing quality problems during manufacture. Because of this, in the above identified applications, there has been proposed the concept of providing this lubricant reservoir as defined by a shelf plate member fixed in the space within the piston main body near the piston crown. However, the prior art methods which have been proposed for securing such a shelf plate member within the piston main body, such as for example securing it with screws, or by fixing it by the spring action of a retainer spring, have been unsatisfactory. In the case of fixing by screws or other fastener members, the vibration, thermal stresses and changes, and accelerative forces to which a piston assembly is subject during operation of the engine make it almost impossible to guarantee that such fasteners should not become unfastened; and in the case of securing with a retainer spring the reliability of fastening is not good, and risks occur of loss of spring action of the spring being caused by high operating temperatures, and of vibration again causing detachment of the shelf plate member.

SUMMARY OF THE INVENTION

Accordingly, it is the primary object of the present invention to provide a piston assembly, which can be well and effectively cooled by lubricant supply to the internal space within it.

It is a further object of the present invention to provide such a piston assembly, which has a shelf plate member of the type described above for defining a lubricant accumulation reservoir, said shelf plate member being secured to the piston main body by a simple and reliable construction.

It is a further object of the present invention to provide such a piston assembly, with which the risk of the shelf plate member becoming detached or displaced is effectively reduced to nil.

It is a further object of the present invention to provide such a piston assembly, which does not require the basic configuration of the piston main body to be altered, in order to provide for the fitting of such a shelf plate member.

It is a yet further object of the present invention to provide such a piston assembly, which is relatively easily assembled.

It is a yet further object of the present invention to provide such a piston assembly, which is easy to manufacture.

It is a yet further object of the present invention to provide such a piston assembly, which does not cost a great deal to manufacture.

It is a yet further object of the present invention to provide such a piston assembly, which can be reliably manufactured without many manufacturing defects being likely to occur.

According to the most general aspect of the present invention, these and other objects are accomplished by, for an internal combustion engine: a piston assembly, comprising: (a) a piston main body, comprising a piston crown portion and a generally hollow cylindrical piston wall portion joining thereto which together define a generally cup-shaped structure, and further comprising two bosses formed in said piston wall portion and located at mutually opposite positions on opposite sides of a central axis of said piston main body so as to have mutually opposing inner end portions, each of said two bosses being formed with a central piston pin hole, axes of said two piston pin holes of said bosses being coincident and intersecting said central axis of said piston main body substantially at right angles; and (b) a lubricant reservoir defining member comprising: (b1) a shelf plate main body portion formed with a depression which defines a lubricant reservoir; and (b2) two major legs, each connecting at one end thereof to a part of said shelf plate main body portion and formed adjacent another end thereof with a hole and with an annular portion surrounding said hole, each of said annular portions being engaged with the inner portion of a corresponding one of said bosses and surrounding the piston pin hole thereof, so as to mount said lubricant reservoir defining member in said cup shaped structure of said piston main body with said shelf plate generally parallel to and opposing said piston crown portion.

According to such a structure, the lubricant reservoir defining member, which in its function of defining a lubricant reservoir helps with the circulation of cooling lubricant for the piston crown portion in a fashion which will be explained hereinafter, is supported within the piston main body by a construction which is secure and simple. Because the annular portions surround the piston pin holes of the bosses, thus, when the piston is assembled to its internal combustion engine by a piston pin being passed through the piston pin holes of the bosses to rotatably mount the piston to its connecting rod, at this time the annular portions surround the piston pin, and hence absolutely and positively these annular portions cannot become detached from their proper places. Further, as will be seen later, because the holes and the annular portions at said other ends of the legs are engaged with the inner end portions of the bosses, thereby during the putting together of the piston assembly the space between said inner end portions of the bosses can usefully be employed for fitting in the lubricant reservoir defining member to the piston main body; and accordingly the construction described above is very easy to assemble, thus providing cheapness and reliability of manufacture. Further, since no very great modification of the structure of the piston main body is required, as compared to a piston main body to which no such lubricant reservoir defining member is provided, the cost and difficulty of design of the structure is significantly reduced.

BRIEF DESCRIPTION OF THE DRAWINGS

The present invention will now be shown and described with reference to the preferred embodiments thereof, and with reference to the illustrative drawings. It should be clearly understood, however, that the description of the embodiments, and the drawings, are given purely for the purposes of explanation and exemplification only, and are none of them intended to be limitative of the scope of the present invention in any way, since the scope of the present invention is to be defined solely by the legitimate and proper scope of the appended claims. In the drawings, like parts and features are denoted by like reference symbols in the various figures thereof, and:

DESCRIPTION OF THE PREFERRED EMBODIMENTS

Figure 1:
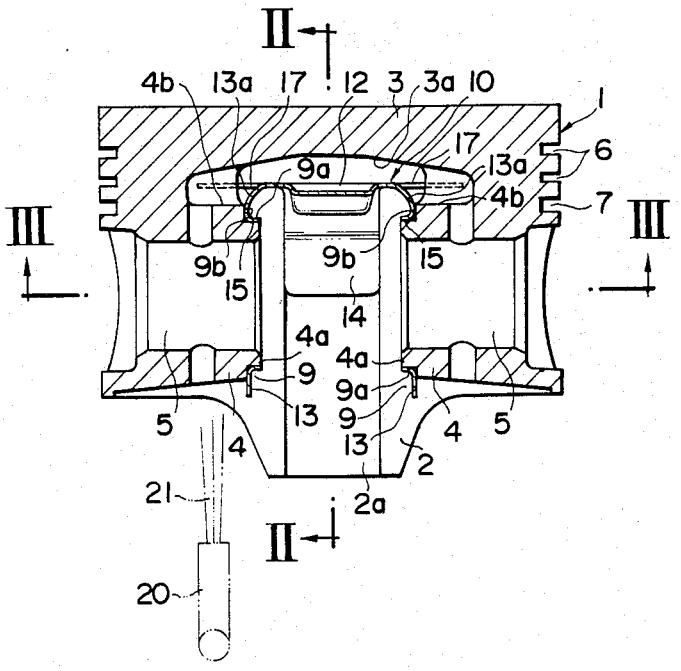
FIG. 1 is a longitudinal sectional view of a first preferred embodiment of the piston assembly for an internal combustion engine according to the present invention, taken in a plane which contains the central longitudinal axes of said piston assembly and of a piston pin fitting hole formed therein.
Figure 2:
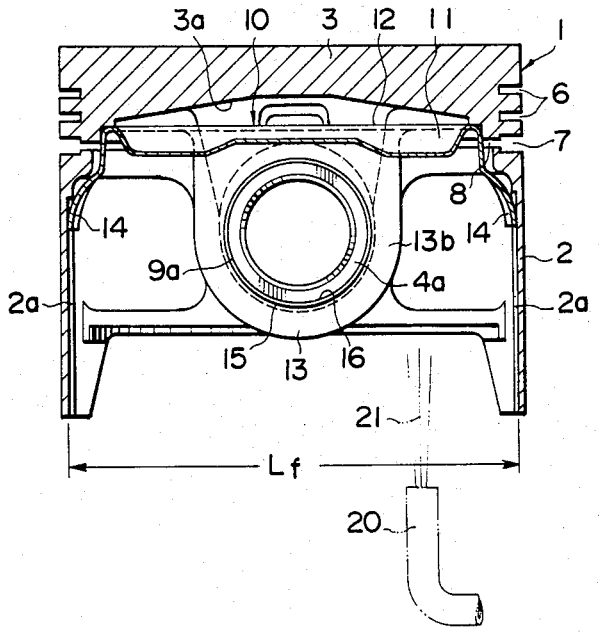
FIG. 2 is another longitudinal sectional view of said first preferred embodiment, taken in a plane shown by the arrows II—II in FIG. 1 and containing said central axis of said piston assembly while being perpendicular to said central axis of said piston pin fitting hole.

The present invention will now be described with reference to the preferred embodiments thereof, and with reference to the appended drawings. FIGS. 1 and 2 show the first preferred embodiment in longitudinal sectional views. The piston assembly according to this first preferred embodiment comprises a piston main body 1 and a lubricant reservoir definoing member 10 mounted therein as will be explained shortly. This main body 1 is typically a cast member, and is made generally as a cup shaped body having: a cylindrical side wall or skirt portion 2, a top wall or crown portion 3, and two boss portions 4. The boss portions 4 are each pierced with a piston pin fitting hole 5, and are contiguous with the crown portion 3 and lie just therebelow as seen in FIGS. 1 and 2, confronting one another on opposite sides of the central axis of the piston assembly; and their inner ends protrude towards one another free of the rest of the piston assembly. The piston pin fitting holes 5 are mutually coaxial, and are adapted to receive a piston pin, not shown in the figures, for pivotably fitting the piston assembly to a connecting rod, also not shown.

The lower surface in FIGS. 1 and 2 of the crown portion 3, i.e. its surface remote from the combustion chamber (not shown) with which this piston assembly cooperates, which constitutes the ceiling surface 3*a* of the internal space within the piston assembly, is formed substantially as a shallow conical surface inclined in the upwards direction; alternatively, this lower shallow surface may be formed as a concavely spherical surface. Circumferentially around the outer surface of the crown portion 3 there are incised two piston ring grooves 6 and an oil scraper ring groove 7, and, as shown in FIG. 2, the bottom of said ring groove 7 is communicated to the internal space within the piston assembly by a plurality of slit holes 8.

Each of the free inwardly protruding end parts of the boss portions 4 is formed with a step shape 9, defined by a narrowed down cylindrical end portion 9*a* of the boss inner end part and by a flat annular surface 9*b* which extends outwards from the base of said end portion 9*a*. The inner surface of the skirt portion 2 of the piston assembly is formed with two longitudinally extending shallow and relatively wide grooves 2*a* which confront one another on opposite sides of the central axis of the piston assembly on a line perpendicular to the central axis of the piston pin fitting holes 5. These grooves 2*a* extend downwards to the lower edge of the skirt portion 2.

Figure 4:
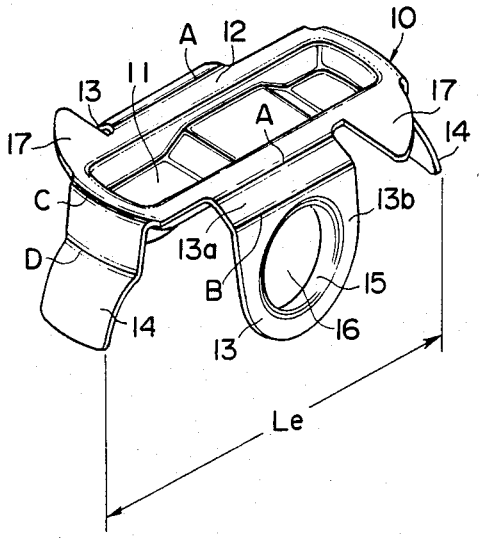
FIG. 4 is a perspective view of a lubricant reservoir defining member comprised in said first preferred embodiment shown in FIGS. 1 through 3, as seen in its unstressed state when not yet fitted to the piston assembly.

The lubricant reservoir defining member 10, shown in FIG. 4 in its free unstressed state in perspective view, is press formed as a whole of a piece of metallic plate of suitable thickness and suppleness and elasticity, such as spring steel plate. The member 10 has a central shelf portion 12 formed generally as a rectangle with a lubricant receiving depression 11 in its interior. Two wider legs 13 are formed by bending downwards (from the point of view of FIG. 4) two protruding ears formed on the central portions of the longer sides of this rectangular central shelf portion 12; and similarly two narrower legs 14 are formed by bending downwards two protruding arms formed on the shorter sides of the shelf portion 12. The narrower legs 14 are of width and length adapted just to fit into the abovementioned grooves 2*a* in the piston skirt 2, and are in fact formed by bending the protruding arms downwards along first lines C close to the shelf portion 12 and then by bending them somewhat outwards along second lines D, so that their main bodies spread outwards somewhat in the free state, as clearly shown in FIG. 4; and the wider legs 13 are in fact formed by bending the protruding ears downwards somewhat along first lines A close to the shelf portion 12 and then by bending them further somewhat downwards along second lines B, so as to define relatively small intermediate leg portions 13*a* and relatively large end leg portions 13*b* which also spread outwards somewhat in the free state, as clearly shown in FIG. 5. The distance apart in the unstressed state of the free ends of the narrower legs 14, designated in FIG. 4 by "Le", is slightly greater than the distance between the bottoms of the grooves 2*a*, designated in FIG. 2 by "Lf". And, referring to FIG. 5 for the dimensions relating to the wider legs 13, the distance apart "La" of the bending lines A between the shelf portion 12 and the intermediate leg portions 13*a* is slightly less that the distance apart "Lb" of the very end surfaces 4*a* of the inwardly protruding end parts of the boss portions 4 so that the legs 13 can pass through between the surfaces 4*a* when they are bent as shown in double dotted lines, while the distance apart "Lc" of the bending lines B between the intermediate leg portions 13*a* and the end leg portions 13*b* is substantially equal to the distance apart "Ld" of the aforementioned flat annular surfaces 9*b* formed on said inward end parts of the boss portions 4. Each of these end leg portions 13*b* is pierced with a circular hole 16 which is bordered with a cylindrical flange 15 whose inner diameter is just appropriate for said flange 15 to fit over one of the aforesaid narrowed down cylindrical end portions 9*a* of the bosses 4. And the lower edge of each of the end leg portions 13*b* is formed in a semicircular shape, and the diameter of these lower ends is greater than the outer diameters of said flat annular surfaces 9*b* on the inward parts of the boss portions 4. Finally, two side wing portions 17 are provided extending from opposite end parts of the two long sides of the central shelf portion 12 not occupied by the abutment of the wider legs 13, in its plane, as shown in FIG. 4.

Figure 5:
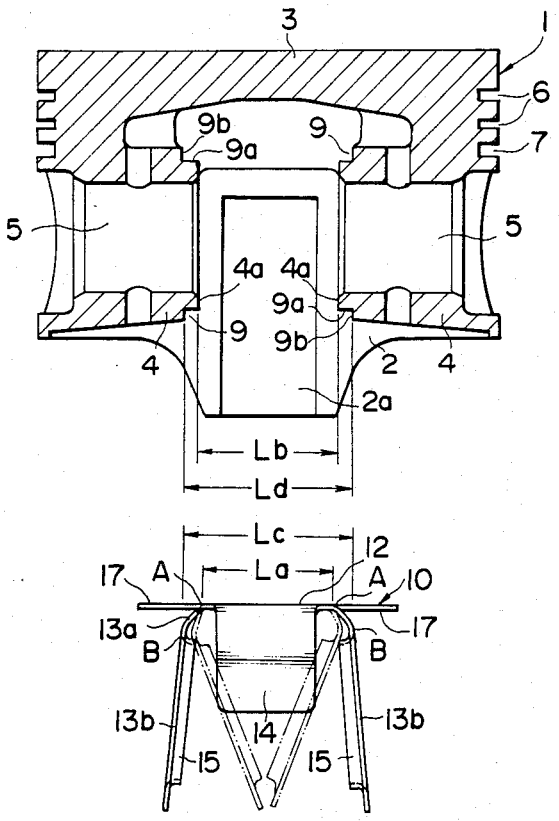
FIG. 5 is a longitudinal sectional view of said first preferred embodiment, taken in the same plane as FIG. 1 but showing the parts thereof in exploded form, for explanation of certain dimensions thereof and of the assembly procedure therefor.

As suggested in FIG. 5, this lubricant reservoir defining member 10 is assembled into the piston body 1 in the following manner, by utilizing its own spring action. First the member 10 is approached towards the under side of the piston body 1, with the shelf portion 12 towards said piston body 1 and parallel to the crown portion 3 and with the long sides of said shelf portion 12 parallel to the central axis of the piston pin fitting holes 5, and then the wider legs 13 of said member 10 are squeezed together somewhat (by hand or by a jig) as shown by the double dotted lines in the figure, so that their maximum distance apart is less than the minimum distance apart Lb between the very end surfaces 4*a* of the inwardly protruding end parts of the boss portions 4, with the legs 13 bending both along the line A and along the line B. Then the member 10 is inserted within the inner space of the piston body 1 in this condition, with the wider legs 13 aligned to the bosses 4 and fitting easily in between said bosses 4, and with the narrower legs 14 aligned to the grooves 2*a*. As this is done these narrower legs 14 engage slidingly into the grooves 2*a* and guide the insertion of the member 10 into said piston body 1. When the holes 16 in the wider legs 13 become aligned with the piston pin fitting holes 5 in the bosses 4, then the squeezing of these legs 13 is released, so that they spring apart under their own spring force so that the outer surfaces of the narrowed down cylindrical end portions 9*a* of the bosses 4 fit into the inner surfaces of the flanges 15 around the holes 13 and the end portions 9*a* enter into the holes 16 until the main body portions of the end leg portions 13*b* rest against the flat annular surfaces 9*b* defined on the inward parts of the boss portions 4.

Thus, the lubricant reservoir defining member 10 comes to be securely fitted to the piston main body 1 by its own spring action, with the flanges 15 fitting around the end portions 9*a* and with the legs 14 also fitting into the grooves 2*a*. At this time, the rotation of the member 10 around the central axis of the piston pin holes 5 is prevented by the fitting of the legs 14 into the grooves 2*a* under their own spring force; but in an alternative embodiment this action could be reinforced by forming the end portions 9*a* of the bosses 4 and the corresponding holes 16 in the leg portions 13 of the member 10 in non circular shapes. It will be understood from the above descriptions that the lubricant reservoir member 10 is easily, reliably, and effectively mountable to the piston main body 1, without the use of any special tools being required, and without any special mounting members being required, simply by the provision on the piston main body 1 of the stepped shapes 9 on the inner ends of the piston pin bosses 4, and of the grooves 2*a*. Thus the piston main body need not be substantially altered, as compared to the main body of a piston to which it is not planned to fit such a lubricant reservoir defining member.

Figure 3:
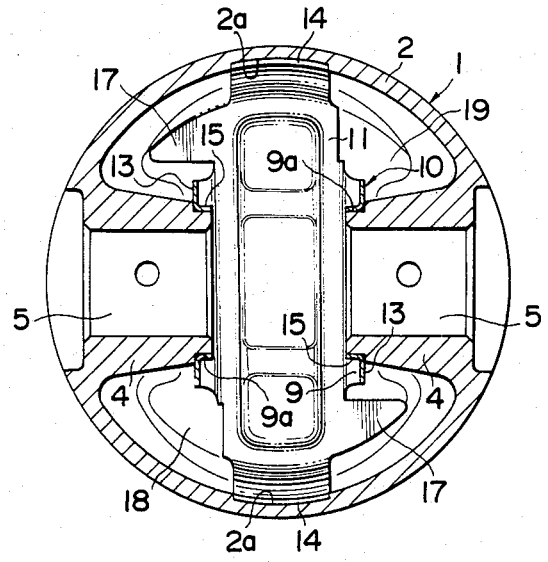
FIG. 3 is a transverse sectional view of said first preferred embodiment, taken in a plane shown by the arrows III—III in FIG. 1 and perpendicular to said central axis of said piston assembly while containing the central axis of said piston pin fitting hole.

When the lubricant reservoir defining member 10 is thus fitted to the piston main body 1, the shelf plate portion 12 extends along a plane which is perpendicular to the central axis of the piston assembly (and which is arranged to be substantially horizontal when the piston assembly is fitted to its internal combustion engine). At this time, a reservoir suitable for receiving a pool of engine lubricant is defined near the lower surface of the piston crown portion 3 by the depression 11. As can be seen in FIG. 3, which is a view from underneath (with respect to FIGS. 1 and 2) of the assembly, at one longitudinal end (the lower end in the figure) of the rectangular shelf plate 12 on one side thereof (the left side in the figure) there is defined a relatively large opening 18 between the side wall 2 of the piston main body 1 and the edge of the shelf plate 12, opening between the space below the plate 12 and the space above said plate 12 between it and the piston crown 3; while at the other longitudinal end (the upper end) and on the other side (the right side) of said rectangular shelf plate 12 there is also similarly defined a relatively large opening 19 between the side wall 2 of the piston main body 1 and the edge of the shelf plate 1, again opening between said spaces below and above the plate 12. Other openings between said spaces are effectively blocked by the shelf plate 12 and/or by the wing portions 17 protruding from the sides thereof. The one 18 of these openings functions as a passage for supplying lubricant to the lubricant receiving depression 11, as will be explained shortly, while the other one 19 of the openings functions as a passage for ejection of lubricant therefrom.

Now the cooling of this piston assembly by the flow of engine lubricant, during operation of the internal combustion engine to which it is fitted, will be explained.

As the piston assembly reciprocates up and down (in the sense of FIGS. 1 and 2) in its cylinder bore (not shown) at high speed, a jet 21 of engine lubricant is squirted upwards at it from a nozzle 20 which is secured to some fixed engine part, not shown, such as the crankcase. This jet 21 is so aimed as to pass largely through the opening 18 between the side wall 2 of the piston main body 1 and the edge of the shelf plate 12, so as largely to pass into the space above said shelf plate 12 between it and the piston crown 3 and to hit against the ceiling surface 3*a* of said piston crown 3. Now, when the piston assembly is moving upwards in FIGS. 1 and 2 away from the nozzle 20, i.e. on its compression or its exhaust stroke, then the speed of the lubricant jet 21 relative to the piston crown 3 is not so very great, so that this jet 21 does not hit the crown ceiling surface 3*a* very hard and most of the lubricant in the jet 21 falls down against the upper side of the shelf plate 12, so as to be accumulated in the lubricant receiving depression 11 and so as to fill it up. As the piston assembly goes over top dead center and starts downwards on its power or intake stroke, then due to its sudden reversal of direction of motion the lubricant in the depression 11 is hurled upwards out of the depression 11 by the action of its inertia and is thrown against the piston crown ceiling surface 3*a* en masse, all over the ceiling surface 3*a*. Since the ceiling surface 3*a* is, as explained above, shaped as a concave cone (or alternatively in a concave spherical shape) this causes the lubricant attached onto the ceiling surface 3*a* to flow towards the central portion of said ceiling surface 3*a* so as to apply better cooling action to the piston crown 3. Meanwhile, during this downward stroke of the piston assembly, also the jet flow 21 of lubricant from the nozzle 20 continues to pass through the opening 18, and, since now the speed of the lubricant jet 21 relative to the piston crown 3 is great, now this jet 21 hits the crown ceiling surface 3*a* quite hard at a point substantially directly above the opening 18. The lubricant from the jet 21 then flows along the ceiling surface 3*a* away from its impact point and towards the central part of the surface 3*a*, and then past the central part towards the part of the ceiling surface 3*a* which opposes the other opening 19, which is, as explained above and as can be seen in FIG. 5, substantially diametrically opposite the opening 18. This flow of lubricant from the jet 21 entrains the lubricant splashed up as explained above from the lubricant reservoir 11 and drags it along with it towards said part of the ceiling surface 3*a* which opposes the opening 19, as a result replacing the lubricant which has absorbed heat from the piston crown 3 with new cool lubricant for further cooling. When the piston assembly approaches its bottom dead center and starts to be accelerated in the upwards direction in the figures, then this lubricant accumulated opposite the opening 19 becomes detached from the piston crown surface 3*a*, again by the action of its inertia, and falls downwards, largely passing through the opening 19. Of course, quite a lot of this lubricant impinges against the shelf plate 12 and becomes again collected in the reservoir 11 therein, to go again through the cycle described above; but by the actions explained above there is ensured a substantial and steady net flow of lubricant in the space between the member 10 and the piston crown 3 across the piston crown surface 3*a* from the general area thereof opposed to the opening 18 to the general area thereof opposed to the opening 19, and generally the flow of lubricant is through the opening 18 from the jet 21, across the piston crown surface while perhaps once or repeatedly entering the pool of lubricant in the reservoir 11, and then out through the opening 19. Also, of course quite a lot of this lubricant detached from the crown surface 3*a* falls down onto the tops of the piston pin bosses 4, and flows around these bosses to their lower surfaces.

This lubricant which flows down around the bosses 4 then mostly flows along the lower parts of the legs 13 which are engaged around these bosses 4, and drips or is flung down into the lubricant sump pan of the engine from the lower extremities of the legs 13, which project downwardly below the bosses. 4. In other words, these lower extremities of the legs 13, which are planar and sharp, act with a cutting action to focus the downwards flow of the lubricant, and this action helps to prevent this downward flow of lubricant from impinging against the sides of the cylinder bore in which the piston assembly is reciprocating. This is very effective for helping to prevent excessive burning of lubricant, which could cause smoking of the exhaust of the engine and pollution problems, as well as causing buildup of carbon deposits in the combustion chambers of the engine and on the piston rings thereof.

Figure 6:
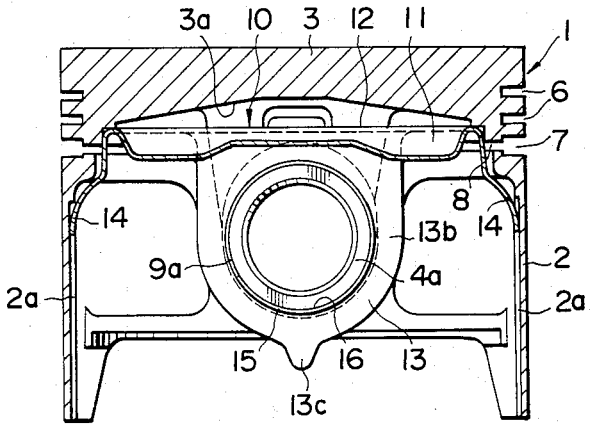
FIG. 6 is a longitudinal sectional view, similar to FIG. 2, of a second preferred embodiment of the piston assembly according to the present invention, taken in a plane corresponding to the plane of FIG. 2 with respect to the first preferred embodiment.
Figure 7:
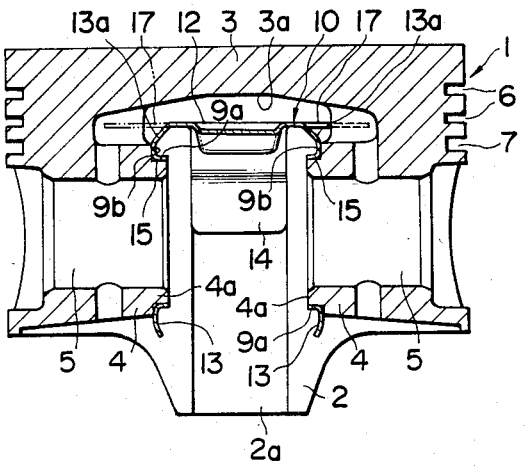
FIG. 7 is a longitudinal sectional view, similar to FIG 1, of a third preferred embodiment of the present invention, taken in a plane corresponding to the plane of FIG. 1 with respect to the first preferred embodiment.

In FIG. 6, there is shown in sectional view a second preferred embodiment of the piston assembly according to the present invention. In this second preferred embodiment, the lower ends of the legs 13 are formed with projections 13*c* for the purpose of aiding with this lubricant cutting and directing action. Apart from this point, the construction of this second embodiment is quite the same as that of the first preferred embodiment described above. Further, in FIG. 7, there is shown in sectional view a third preferred embodiment of the piston assembly according to the present invention. In this third preferred embodiment, the lower ends of the legs 13 are curved inwards towards one another, again for the purpose of aiding with the lubricant cutting and directing action. Again, apart from this point, the construction of this third embodiment is the same as that of the first preferred embodiment described above.

Figure 8:
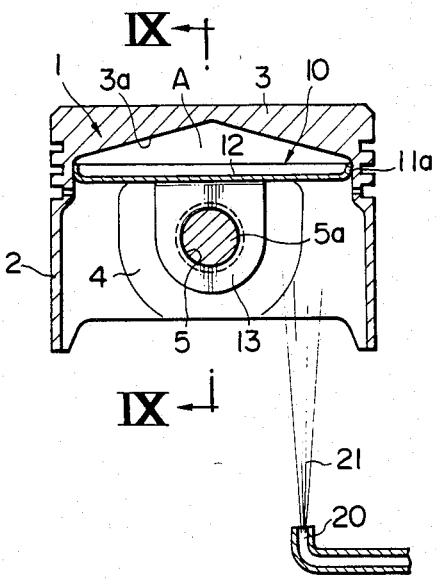
FIG. 8 is a longitudinal sectional view, similar to FIGS. 2 and 6, of a fourth preferred embodiment of the present invention, taken in a plane corresponding to the planes of FIGS. 2 and 6 with respect to the first and second preferred embodiments respectively.
Figure 9:
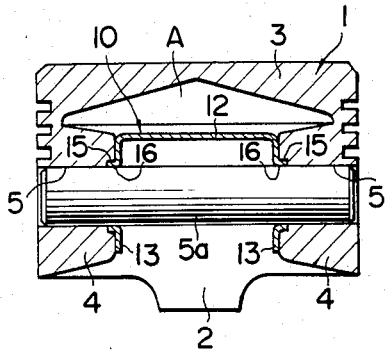
FIG. 9 is a longitudinal sectional view, similar to FIGS. 1 and 7, of said fourth preferred embodiment, taken in a plane shown by the arrows IX—IX in FIG. 8, and containing the central axis of the piston assembly.
Figure 10:
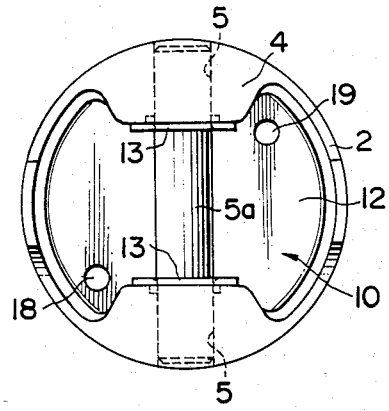
FIG. 10 is a bottom view of said fourth preferred embodiment.
Figure 11:
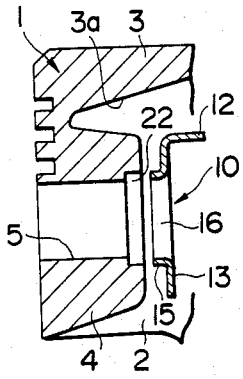
FIG. 11 is an enlarged partial sectional view of a part of said fourth preferred embodiment, taken in the same plane as FIG. 9, showing how a protruding engagement ring portion of a lubricant reservoir defining member thereof fits into a recess defined around a piston pin fitting hole thereof.

In FIGS. 8 through 10, there is shown a fourth preferred embodiment of the piston assembly according to the present invention. In this fourth preferred embodiment, the differences are as follows. First, the openings 18 and 19 for passage of lubricant are defined by actual holes through the shelf plate member 12, rather than being defined between it and the piston main body 1; but these openings in this embodiment perform the same functions. Further, the cylindrical flanges 5 around the holes 16 in the legs 13 are not fitted around the inner end portions of the piston pin bosses 4 as was the case in the first three embodiments, but are instead fitted into larger diameter opened out portions 22 in the inner ends of the piston pin receiving holes 5, as may be best seen in FIG. 11. This alternative method of fitting the lubricant reservoir defining member 10 to the piston main body 1 is generally similar in its effects to the method utilized in the first three preferred embodiments described above, and has the same good advantages as regards simplicity and easy assemblability and reliability; but either may be more desirable, depending upon particular circumstances.

Although the present invention has been shown and described with reference to a number of preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown preferred embodiments, or of the drawings, but solely by the scope of the appended claims, which follow.

What is claimed is:

1. For an internal combustion engine:

a piston assembly, comprising:

(a) a piston main body, comprising a piston crown portion and a generally hollow cylindrical piston wall portion joining thereto which together define a generally cup-shaped structure, and further comprising two bosses formed in said piston wall portion and located at mutually opposite positions on opposite sides of a central axis of said piston main body so as to have mutually opposing inner end portions, each of said two bosses being formed with a central positon pin hole, axes of said two piston pin holes of said bosses being coincident and intersecting said central axis of said piston main body substantially at right angles; and (b) a lubricant reservoir defining member comprising:

(b1) a shelf plate main body portion formed with a depression which defines a lubricant reservoir; and (b2) two major legs, each connecting at one end thereof to a part of said shelf plate main body portion and formed adjacent another end thereof with a hole and with an annular portion surrounding said hole, each of said annular portions being engaged with the inner portion of a corresponding one of said bosses and surrounding the piston pin hole thereof, so as to mount said lubricant reservoir defining member in said cup shaped structure of said piston main body with said shelf plate generally parallel and opposing said piston crown portion.

2. A piston assembly according to claim 1, wherein said lubricant reservoir defining member further comprises two minor legs, each connecting at one end thereof to a part of said shelf plate main body portion and engaged at another end thereof to an inner surface of said piston wall portion.

3. A piston assembly according to claim 2, wherein said inner surface of said piston wall portion if formed with two longitudinally extending grooves, into each of which is engaged one of said other ends of said minor legs.

4. A piston assembly according to claim 2 or claim 3, wherein said shelf plate main body portion of said lubricant reservoir defining member is generally shaped as a rectangle, said one ends of said major legs each being connected to a part of one of the longer sides of said rectangular shape, while said one ends of said minor legs are each connected to a part of one of the shorter sides of said rectangular shape.

5. A piston assembly according to claim 4, wherein said shelf plate main body portion of said lubricant reservoir defining further comprises two wing shapes, each of which is connected to a part of one of said longer sides of said rectangular shape as located adjacent to mutually different ends of said longer sides of said rectangular shape.

6. A piston assembly according to claim 5, wherein between said shelf plate main body portion and the inner wall of said piston wall portion there are left two apertures which are located adjacent to mutually different ends of said longer sides of said rectangular shape.

7. A piston assembly according to claim 1, wherein said shelf plate main body portion of said lubricant reservoir defining member substantially intercepts across an internal space in said cup-shaped structure of said piston main body, and is pierced with two apertures which are located at mutually opposite positions on opposite sides of the central axis of said piston main body.

8. A piston assembly according to claim 1, wherein each of said major legs further comprises a tubular flange abutting to the circumference of said hole, and each of said inner end portions of said bosses is formed with a cutaway portion which receives said tubular flange so as to engage said major leg to said boss.

9. A piston assembly according to claim 8, wherein said cutaway portions of said bosses are formed on the outer circumferences of the inner end portions thereof.

10. A piston assembly according to claim 8, wherein said cutaway portions of said bosses are formed on the inner circumferences of the inner end portions thereof.

11. A piston assembly according to claim 1, wherein said major legs are bent at portions thereof immediately adjacent to said part of said shelf plate main body portion to which they are connected, and are further again bent at portions thereof somewhat further away from said shelf plate main body portion.

12. A piston assembly according to claim 1, wherein parts of said major legs on the side of said bosses remote from said piston crown extend further away from said piston crown than do any parts of the periphery of said bosses.

13. A piston assembly according to claim 12, wherein said parts of said major legs on the side of said bosses remote from said piston crown are formed with projections.

14. A piston assembly according to claim 12, wherein said parts of said major legs on the side of said bosses remote from said piston crown are curved inwards towards one another.

* * * * *

UNITED STATES PATENT AND TRADEMARK OFFICE

CERTIFICATE OF CORRECTION

PATENT NO. : 4,506,632

DATED : March 26, 1985

INVENTOR(S) : M. Kanda, et al.

It is certified that error appears in the above-identified patent and that said Letters Patent is hereby corrected as shown below:

Column 4, line 42, change "definoing" to --defining--.

Column 4, line 63, omit the word "shallow".

Column 5, line 51, change "that" to --than--.

Column 9, line 9, change "flanges 5" to --flanges 15--.

Column 9, line 65, change "parallel and" to --parallel to and--.

Column 10, line 20, change "defining" to --defining member--.

Signed and Sealed this

*First* Day of *October 1985*

[SEAL]

*Attest:*

*Attesting Officer*

DONALD J. QUIGG

*Commissioner of Patents and Trademarks—Designate*